US005999162A

United States Patent [19]

Takahashi et al.

[11] Patent Number: 5,999,162

[45] Date of Patent: Dec. 7, 1999

[54] GRAPH DISPLAYING METHOD AND APPARATUS AND PROCESSING OPERATION MONITORING APPARATUS

[75] Inventors: Shuichi Takahashi, Hitachi; Hiroshi Kuwahara, Tokyo; Hitoshi Yoshino, Chiba; Keiji Oshima, Katsuta, all of Japan

[73] Assignee: Hitachi, Ltd., Tokyo, Japan

[21] Appl. No.: 07/530,030

[22] Filed: May 29, 1990

[30] Foreign Application Priority Data

May 26, 1989 [JP] Japan ..... 1-133589

[51] Int. Cl.[6] ..... G09G 5/36

[52] U.S. Cl. ..... 345/134; 345/121

[58] Field of Search ..... 340/724, 726, 340/722, 793, 747; 364/487; 358/22, 182; 345/134, 121, 123, 125

[56] References Cited

U.S. PATENT DOCUMENTS 4,093,995 6/1978 Smith et al. ..... 364/900
4,233,631 11/1980 Mahler ..... 358/22
4,829,293 5/1989 Schlater ..... 345/134
4,890,099 12/1989 Takano ..... 340/726

*Primary Examiner*—Dennis-Doon Chow
*Attorney, Agent, or Firm*—Antonelli, Terry, Stout & Kraus, LLP

[57] ABSTRACT

In a graph displaying method and apparatus and a processing operation monitoring apparatus, a succession of graph points representing the progress of a process are sequentially displayed from one side to the other on the graph display area of a screen, one added at a time to the leading end of the graph. When the latest graph point arrives at the right end of the graph display area, the graph is shifted back leftwardly to a predetermined position at a speed that can be followed by the operator's eyes, whereupon an additional succession of graph points are sequentially displayed at the leading end of the graph. While the graph is being shifted from the right end of the graph display area to the predetermined position, a plurality of transient graphs is successively displayed from the start position of the movement to the terminating position, thus maintaining continuity of the displaying graph so that the operator can monitor the progress of the process without interruption and/or misrecognition.

20 Claims, 8 Drawing Sheets

GRAPH DISPLAYING METHOD AND APPARATUS AND PROCESSING OPERATION MONITORING APPARATUS

BACKGROUND OF THE INVENTION

1. Field of the Invention

This invention relates to a graph displaying method and apparatus and a processing operation monitoring apparatus for displaying measured data, as a graph, on a display screen and more particularly to a technical concept for displaying a transient graph in which the graph to be displayed is varied in coordinate by winding up the displayed graph, by changing a display range or the like.

2. Description of the Related Art

Heretofore, a graph displaying method is known in which a new data point of data generated in time series is at all times displayed as an additional graph point on the right end of a display screen while old data points are displayed so as to be moved toward the left end of the display screen. However, in this conventional method, the graph normally continues moving from the right side to the left side on the display screen so that it is difficult for an operator to observe the graph.

To this end, a graph displaying apparatus in an effort to solve the conventional problem is disclosed in Japanese Utility Model Laid-Open Publication No. 11751/1986. In the graph displaying apparatus, a succession of graph points are displayed in order rightwardly from a reference position, located in the midst of a graph display area of a display screen, one graph point at a time being added to the leading end of the graph. When the latest graph point reaches the end of the graph display area, the entire graph is caused to jump back leftwardly along a time axis in such a manner that the end of the graph meets the reference position. This process is hereinafter called a "winding-up process". As subsequent data are generated, an additional succession of graph points representing the subsequent data are displayed in order, restarting off rightwardly from the reference position. When the right end of the new succession of graph points arrives at the end of the graph display area, then another winding-up process is performed. Therefore, only when the right end of the graph reaches the end of the graph display area, the graph is instantaneously moved to the reference position, without moving all the time.

According to this prior concept of the Japanese Publication 11751/1986, it is easy to monitor the data because the graph is kept still until the right end of the graph arrives at the end of the graph display area, whereupon a winding-up process is performed, namely, the graph is instantaneously moved back to the start position. Since continuity of the graph on the display screen is gone down about this graph winding-up action, the operator's monitoring of the graph would be interrupted due to the graph winding-up process.

In particular, assume that the reference position is located in the midst of the graph display area in order to leave on the display screen the past data points which for a predetermined time precedes the latest data point at the time immediately after the graph winding-up action. In this case, the more the old data points are secured, the narrower a part of the graph display area between the reference position and the rightside end of the display screen is obtained. As a consequence, the winding-up action would occur frequently to thereby break the operator's monitoring at increased frequency.

SUMMARY OF THE INVENTION

It is therefore an object of this invention to provide a graph displaying method and apparatus in which a graph winding-up action can be performed without obstructing the operator's observation.

Another object of the invention is to provide a graph displaying method and apparatus in which the range of a graph can be changed over, i.e., can be expanded or reduced without breaking down continuity of monitoring.

Still another object of the invention is to provide a processing operation monitoring apparatus in which a graph representing a quantity of process parameter can be displayed so as to facilitate the operator's monitoring.

According to a first aspect of this invention, there is provided a graph displaying method for sequentially displaying a data quantity varying with time, as a succession of graph points, on a display screen from one end of the display screen toward the other end. The method comprising: moving the graph to a predetermined position toward the one end of the display screen at a speed which can be followed by the operator's eyes when the succession of graph points reaches the end of a graph display area on the display screen, and further displaying an additional succession of graph points, one at a time at a leading end of the graph.

The predetermined position may be located at an arbitrary position and should preferably be located in the midst of the graph display area or between the center and the end of the graph display area.

According to a second aspect of the invention, N number of successive transient graphs are sequentially displayed during the moving of the graph from a start position to an end position, where N stands for an integer equal to or larger than one. Preferably, the N number of successive transient graphs should be sequentially erased, each immediately after being displayed. Alternatively, the N number of successive transient graphs may be sequentially erased in such a manner that the intensities of the graphs are reduced gradually in the order the successive transient graphs have been displayed.

A time taken to move the graph from the end of the graph display area to the predetermined position is optionally settable. The value N is also optionally settable. During a single movement, a time interval of displaying the N number of successive transient graphs is variable with time. Distances between the N number of successive transient graphs are non-uniform.

According to a third aspect of the invention, a graph displaying method is provided for sequentially displaying a data quantity varying with time, as a succession of graph points, on a display screen from one end of the display screen toward the other end. The method comprising: displaying, when the succession of graph points reaches the end of a graph display area of the display screen, an additional succession of graph points which has been moved to a predetermined position toward the one end of the display screen, while the first-named succession of graph points having reached the end of the graph display area is maintained as displayed; and reducing the intensities of the first-named succession of graph points gradually, while increasing the intensities of the additional succession of graph points gradually.

According to a fourth aspect of the invention, there is provided a graph displaying method for displaying data in the form of a graph within a graph display area of a display screen, in which when a range of the graph display area is switched to a new range with the graph being displayed in the graph display area, the displaying of the graph is modified for the new range such that a plurality of transient graphs from the graph are sequentially displayed of the previous range to the graph of the new range.

According to a fifth aspect of the invention, there is provided a graph displaying method for displaying data in the form of a graph within a graph display area of a display screen, in which when a range of the graph display area is switched to a new range with the graph being displayed in the graph display area, the displaying of the graph is modified for the new range, in such a manner that the intensity of the graph of the previous range is gradually reduced, while gradually increasing the intensity of the graph of the new range.

According to a sixth aspect of the invention, there is provided a processing operation monitoring apparatus comprising: a data processing unit for sequentially operating process data, which is inputted and varies with time, into a succession of graph points for controlling displaying of the graph; and a display unit for sequentially displaying the succession of graph points applied from the processing unit on a display screen from one side thereof to the other; the data processing unit being equipped with an image drawing means for sequentially displaying, when changing a time-axis coordinate of the graph (e.g., winding up the graph or changing over the range of graph graduations), a plurality of graphs representing transient states from the graph before the varying to the graph after the varying.

With the first feature of this invention, in winding up the graph when a succession of graph points reaches the end of the graph display area, transient graphs are successively displayed on the way to the predetermined position, instead of merely letting the graph jump to the predetermined position, namely, the winding-up position. Therefore continuity of the graph can be maintained even during winding-up of the graph. By adjusting the number of the transient graphs and the display interval thereof, it is possible to move the graph smoothly at a speed that can be followed by the operator's eyes.

The smoothness of movement of a graph during winding-up of the graph is determined by the number of the transient graphs, which is in turn determined by the time taken to wind up the graph and the time interval of displaying the individual graphs. The number of the transient graph points is also determined by the winding-up position and the distances between the individual graphs.

Therefore, by setting these parameters and their mutual relation suitably, it is possible to move the graph smoothly at a speed that can be followed by the operator's eyes. Thus, there is no possibility that the operator's monitoring would be broken down instantaneously during the winding-up process.

Since the parameters may be changeably set by the user, it is possible to realize a suitable winding-up action according to the use. Further, the parameters may be changed even during a single winding-up process; for example, the movement of the graph may be slowed down at the start and end of the winding-up action and may be accelerated therebetween.

The second feature of the invention provides for the intensities of the two graphs before and after the winding-up action to be varied gradually to keep the continuity of the two graphs, instead of displaying the transient graphs during the winding-up process.

In addition, this invention may be used in displaying the graph smoothly so that any change of graph display in the data or vertical range and/or in the time or horizontal range of the graph display area can be followed by the operator's eyes.

The above and other advantages, features and additional objects of this invention will be apparent to those versed in the art upon making reference to the following detailed description and the accompanying drawings in which several preferred embodiments incorporating the principles of this invention are shown by way of illustrative examples.

DETAILED DESCRIPTION

Figure 1:
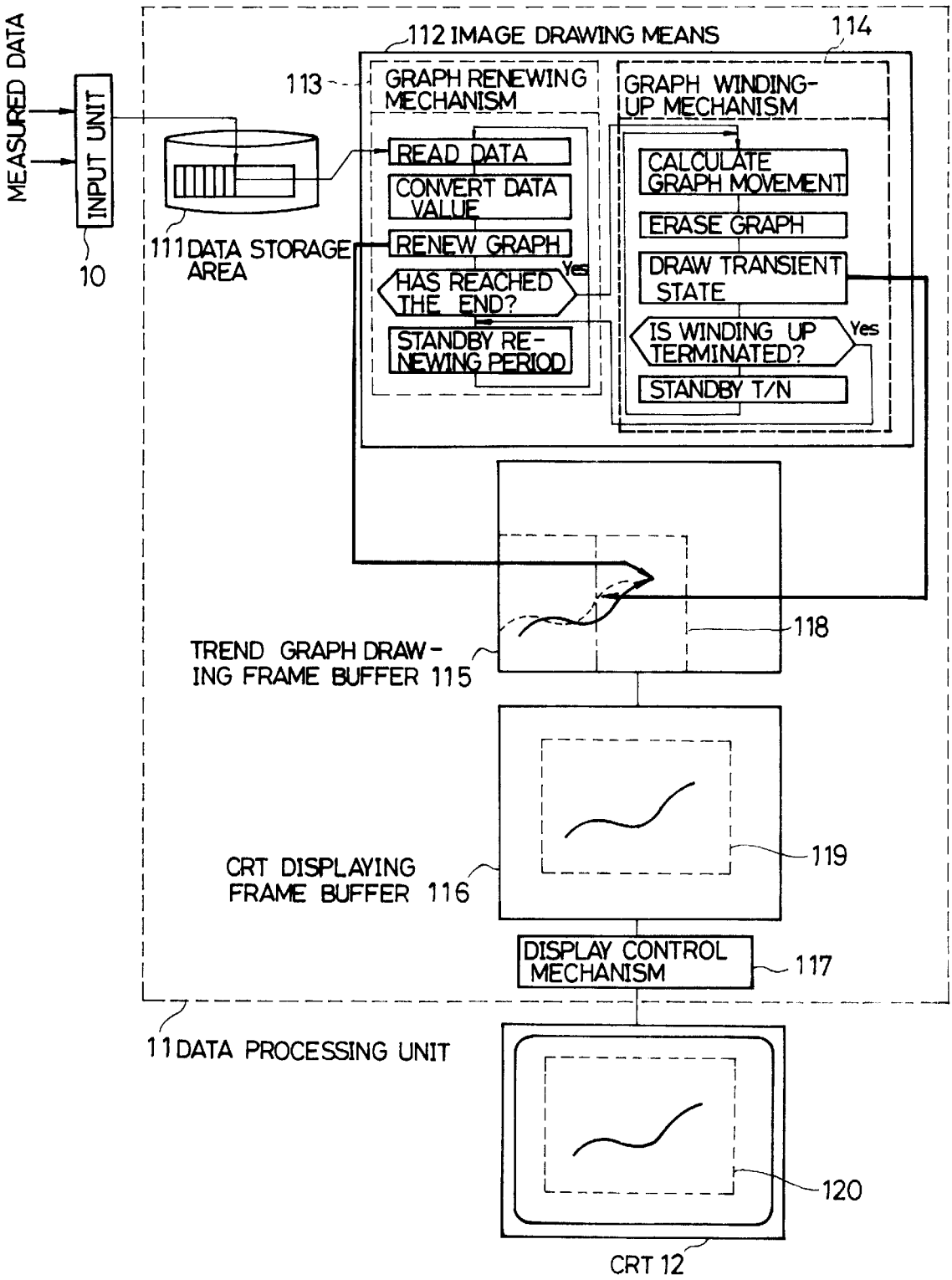
FIG. 1 is a block diagram showing a graph displaying apparatus embodying this invention.

The principles of this invention are particularly useful when embodied in a trend graph displaying apparatus such as shown in FIG. 1.

As shown in FIG. 1, this trend graph displaying apparatus generally comprises an input unit 10 for periodically collecting measured data, a data processing unit 11 for processing the measured data, which is acquired by the input unit 10, into display data, and a display means (CRT in this embodiment) 12 for progressively displaying in order the display data given from the data processing unit 11.

The data processing unit 11 includes a data storage area 111, an image drawing means 112 composed of a graph renewing mechanism 113 and a graph winding-up mechanism 114, a first frame buffer 115 for drawing a trend graph, a second frame buffer 116 for displaying a graph on a CRT, and a display control mechanism 117.

The data storage area 111 stores the data, which has been acquired in the input unit 10, as time series data with respect to the time point at which the data was generated. Every time each latest data is stored in the storage area 111, the graph renewing mechanism 113 fetches the data value and converts it into a graph point corresponding thereto thus thereby progressively drawing a graph in a graph display area 118 of the trend graph drawing frame buffer 115.

The graph drawn in the trend graph frame buffer 115 is transferred to the graph display area 119 of the second frame buffer 116 for displaying the graph on the CRT 12. The display control mechanism 117 converts the content of the second frame buffer 116 into a video signal in synchronism with the scanning frequency of the CRT 12 and displays it on the display screen of CRT 12. Alternatively, the graph may be drawn directly from the image drawing means 112 onto the second frame buffer 116, without using the first frame buffer or trend graph drawing frame buffer 115.

The graph winding-up action of the apparatus of FIG. 1 will now be described in connection with FIG. 2. The reference numerals used in FIG. 1 designate the similar elements in FIG. 2.

As mentioned above, the change in the content of the graph display area 118 of the trend graph drawing frame buffer 115 is successively reflected on the content of the graph display area 119 of the second frame buffer 116 so that the content of this second frame buffer 116 is displayed on the CRT 12 without being changed.

Figure 2:
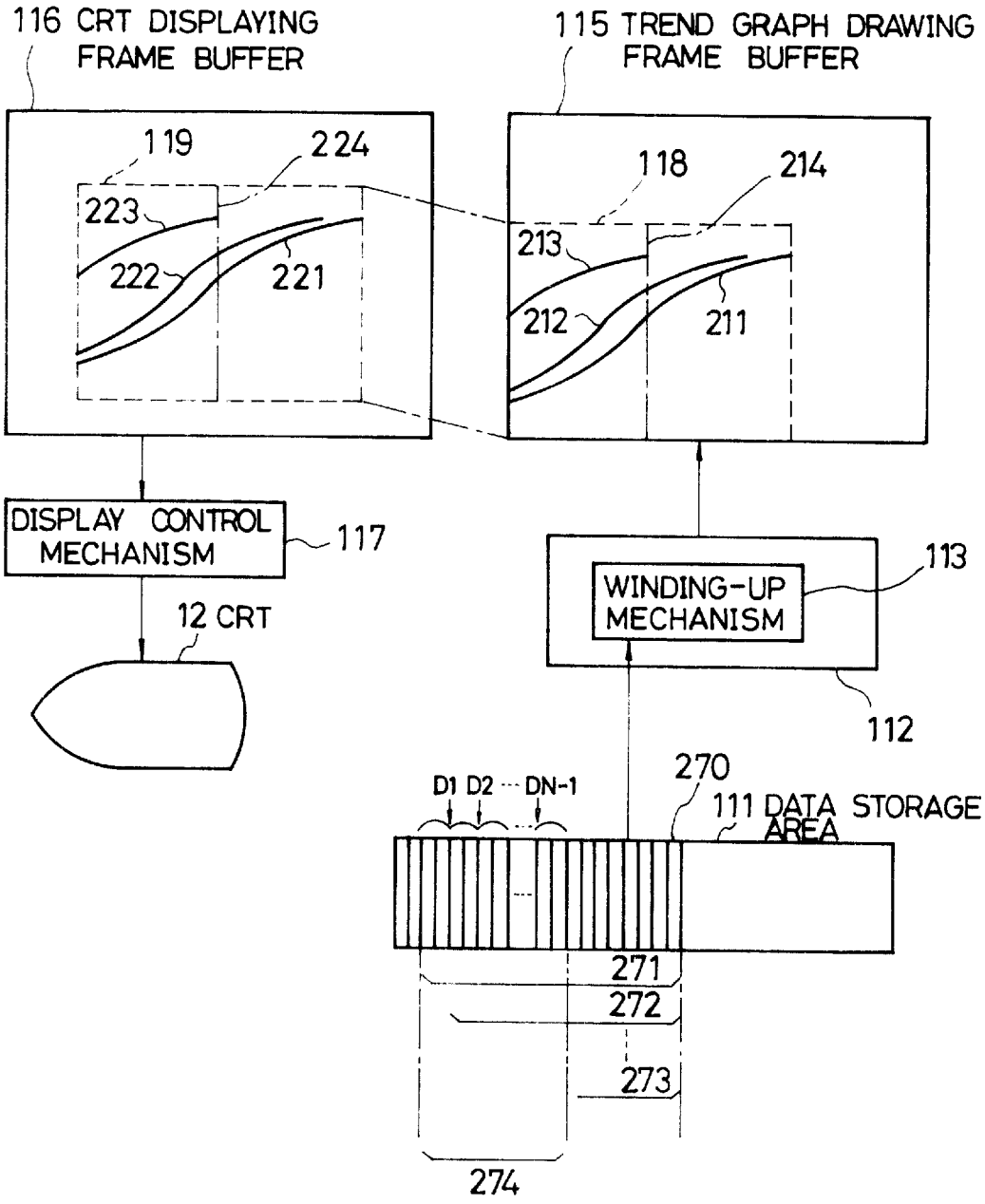
FIG. 2 is a diagram showing the operation of the graph displaying apparatus of FIG. 1.

As shown in FIG. 2, in a graph 211 in the graph display area 118 of the trend graph drawing frame buffer 115, a succession of graph points have been drawn progressively by the graph renewing mechanism 113, and the latest graph point has just arrives at the right end of the graph display area 118. Graph 211 is matched with the graph 221 in the second frame buffer 116 and also corresponds to a data range 271 in the data storage area 111.

A graph 213 in the trend graph drawing frame buffer 115 is the one that has been generated by winding up the graph 211 to the winding-up position 214 as the graph 211 reaches the right end of the graph display area 118. This graph 213 is matched with a graph 223 in the second frame buffer 116 and is also corresponding to a data range 273 in the data storage area 111.

This embodiment is intended to maintain continuity of display of the graph about the winding-up process by additionally displaying the midcourse of the winding-up process. To this end, the graph winding-up mechanism 114 divides a differential section of older data, between the data range 271 being used just before the start of winding-up of the data storage area 111 and the data range 273 being used after the termination of winding-up, into N number of subsections, and names such divided positions by $D_1, D_2, \ldots D_{N-1}$ respectively in time sequence.

The data associated with the positions $D_1, D_2, \ldots D_{N-1}$ show N number of transient states of the moving graph during the winding-up process. The larger the number of subsections N is set, the more smoothly the graph can be moved during the winding-up action.

Assuming that it is time to start the winding-up process as the graph reaches the end of the graph display area, the image drawing means 112 fetches out of the data storage area 111 the data of the range 272 from the divided position $D_1$ up to the latest data 270 by the graph winding-up mechanism 114 therein, and draws a graph 212 from the leading end of the graph display area 118 on the trend graph drawing frame buffer 115.

The thus drawn graph is transferred to the graph display area 119 in the second frame buffer 116 and is converted into graphic signals through the display control mechanism 117, thereby being displayed on the CRT 12. After the lapse of a very short time AT, the graph winding-up mechanism 114 erases the content of the graph display area 118 on the trend graph drawing buffer 115.

Then the graph winding-up mechanism 114 fetches out of the data storage area 111 the data from the divided position $D_2$ up to the latest data 270 and performs drawing, displaying and erasing. Subsequently, these drawing, displaying and erasing actions are repeated sequentially for each of the subsequent divided positions $D_3, D_4, \ldots D_{N-1}$.

Accordingly, the graph on the CRT 12 represents its transient state as moved from the right end to the winding-up position in the graph display area. During that time, every time the graph moves to each of the divided positions $D_1, D_2, \ldots$, a part of the past data disappears from the display screen. Upon completion of the winding-up process, a graph is displayed from the starting end to the winding-up position in the graph display area based on the latest data.

For data having generated after completion of the winding-up process, an additional succession of graph points are displayed gradually from the winding-up position toward the right end of the graph display area.

By providing the graph renewing mechanism and the graph winding-up mechanism in the image drawing means independently of each other, it is possible to perform a winding-up process in parallel with displaying latest data even as the latest data is generated during the winding-up action. But these two mechanisms may be unified into a single unit.

Since in the data storage area 111 time information concerning the time of generation of individual measured data is stored as described above, this time information can be displayed in terms of graph graduations. In that case, the time information also is moved and drawn in the trend graph drawing frame buffer 115 in synchronism with the movement of the graph. In an alternative way, the time information in the associated area of the second frame buffer 116 may be directly rewritten.

According to this embodiment, because during its winding-up process the graph can be moved at a speed that can be followed by the operator's eyes, there is no possibility that monitoring of the graph may be broken down even at a moment. For example, assume that a quantity of process parameter varying with time is acquired to produce graph-point data and that the operation of the process is monitored while a trend graph is being drawn on the display screen. In this case, even when the graph reaches the end of the graph display area to be wound up, the operator's observation will be kept from any interruption so that the graph can be monitored easily without fail.

Figure 3:
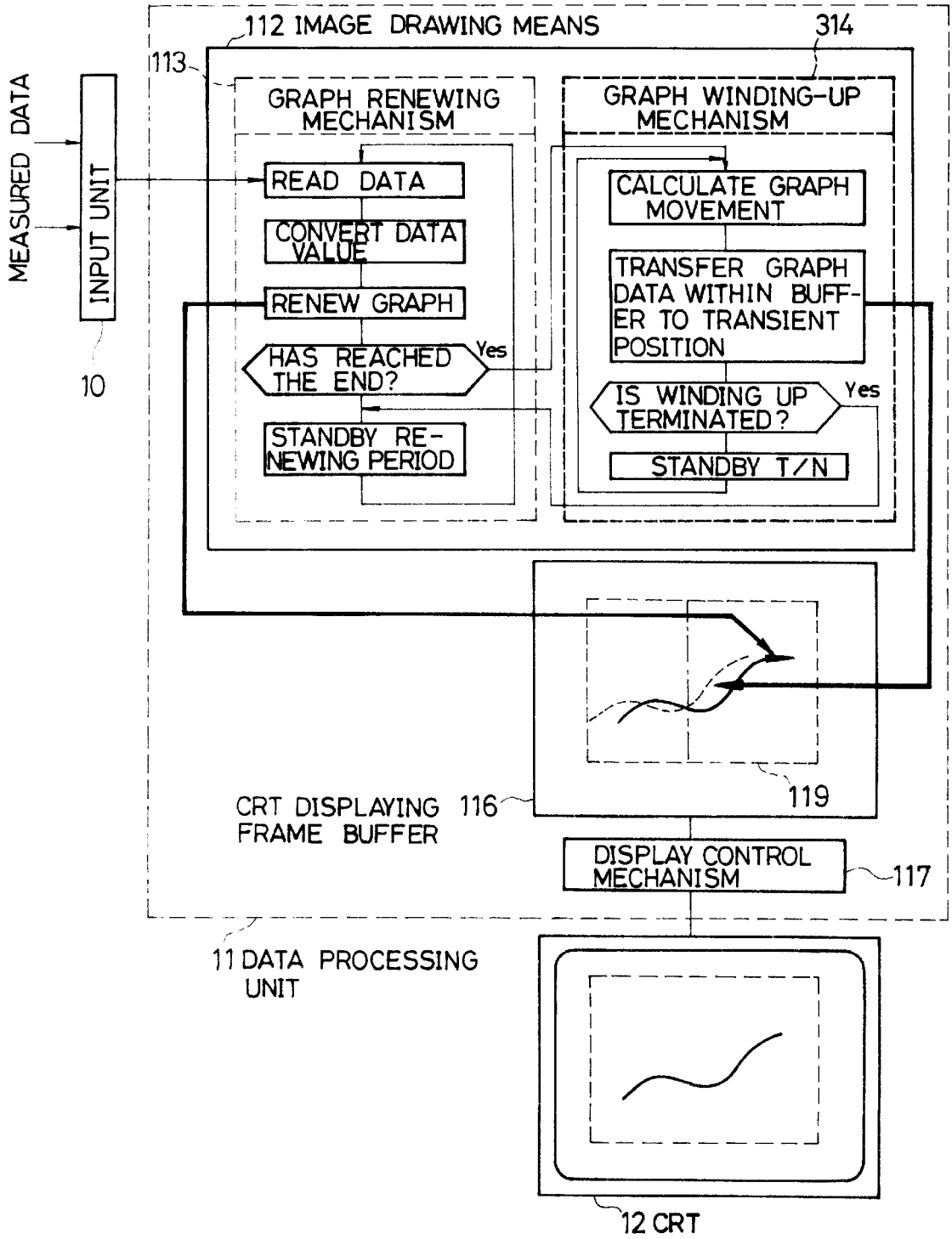
FIG. 3 is a block diagram showing a modified graph displaying apparatus according to another embodiment.

FIG. 3 shows a trend graph displaying apparatus according to a second embodiment. The reference numerals used in FIG. 3 designate the similar elements in FIGS. 1 and 3.

In this embodiment, unlike the first embodiment of FIG. 1, the image drawing means 112 fetches measured data directly from the input unit 10. The graph renewing mechanism 113 of the image drawing means 112 converts the fetched data into graph points corresponding to their data values, and adds the graph points directly and successively one at a time to the leading end of the graph on the second frame buffer 116. The content of the second frame buffer 116, like in the first embodiment of FIG. 1, is converted into a video signal by the display control mechanism 117 and is thus displayed on the screen of the CRT 12. As the latest graph point arrives at the end of the graph display area, the graph winding-up action is realized by transferring the data within the second frame buffer 116 by the graph winding-up mechanism 314.

The winding-up action of the graph winding-up mechanism 314 will now be described in connection with FIG. 4.

Figure 4:
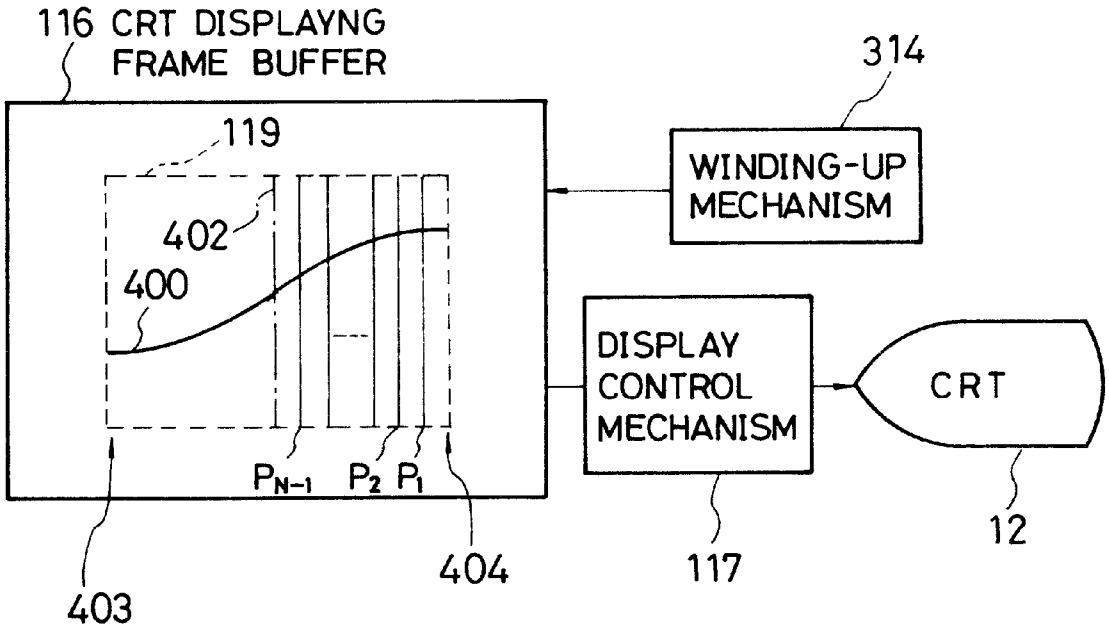
FIG. 4 is a diagram showing the operation of the graph displaying apparatus of FIG. 3.

In FIG. 4, a graph 400 displayed in the graph display area 119 of the second frame buffer 116 indicates that the leading one of successively added graph points has reached the end of the graph display area, at which time the winding-up action will occur.

In this embodiment, a section between the terminal end 404 of the graph display area 119 and a winding-up position 402, which is located halfway between the start end 403 and the terminal end 404 of the graph display area 119, is divided into N number of subsections, and these divided positions are referred to as $P_1, P_2, \ldots P_{N-1}$ respectively in order from the terminal end 404. Here the numeral value N is the same as that described in the first embodiment.

When the leading end one of successive graph points arrives at the terminal end of the graph display area to start the winding-up process, the graph winding-up mechanism 314 performs internal burst transfer of the data in the second frame buffer 116 in such a manner that the data at the end of the graph display area 119 is moved to the divided position $P_1$. After termination of this transfer, the graph wound up by only one subsection from the end 404 of the graph display area is displayed on the screen of the CRT 12 by the display control mechanism 117.

Subsequently, after the lapse of a very short time ΔT, the graph winding-up mechanism performs internal burst transfer of the content of the second frame buffer 116 such a manner that the leading end of the graph located at the position $P_2$ is moved to the divided position $P_2$. The content of the second frame buffer 116 is displayed just after completion of the transfer on the display screen of the CRT 12.

With continued winding-up process, the graph is successively wound up to the divided positions $P_3$, $P_4$, . . . $P_{N-1}$ and finally arrives at the winding-up position 402 to thereby complete the winding-up action. Then an ordinary succession of graph points for new data are sequentially added toward the terminal end of the graph display area.

In this embodiment, like in the first embodiment, the graph winding-up process can be performed so smoothly as to be followed by the operator's eyes.

Figure 5:
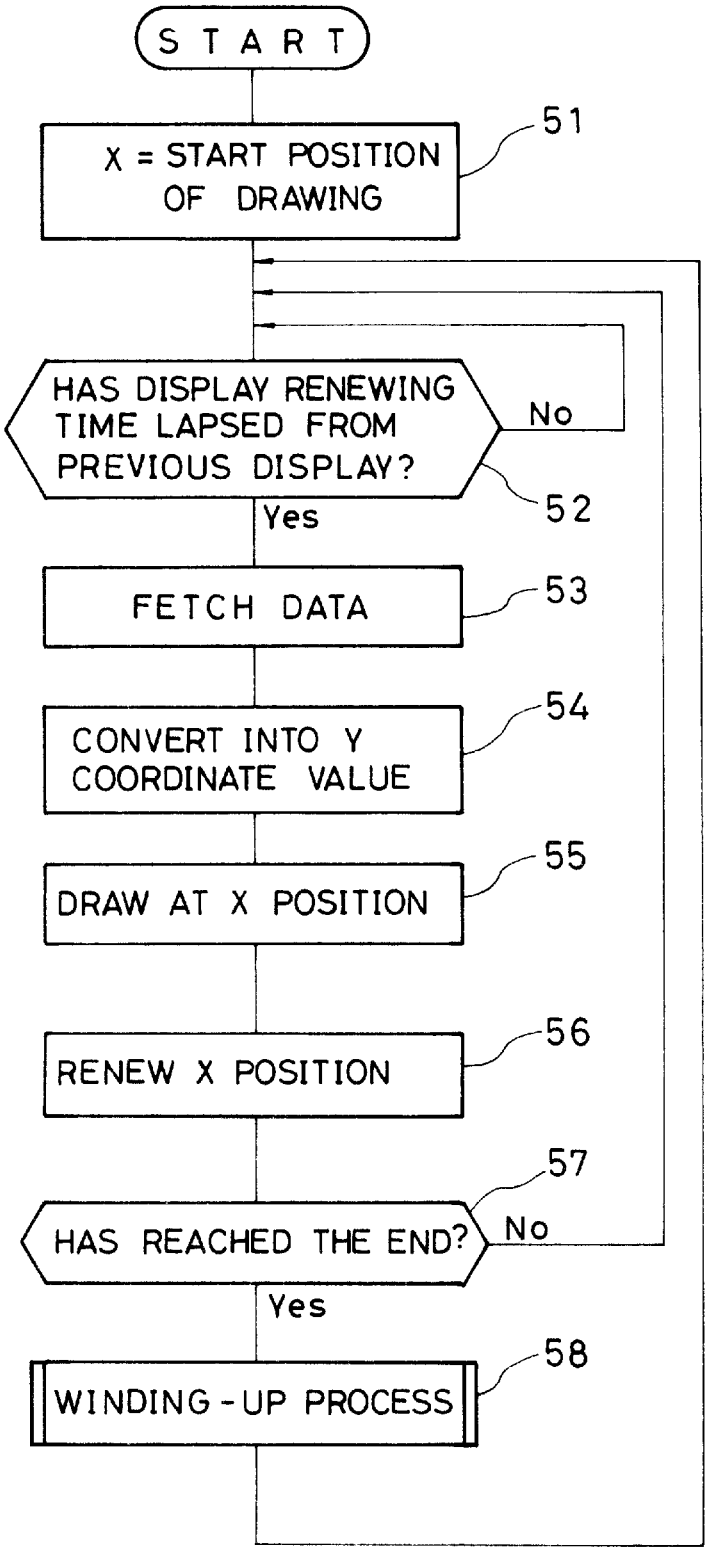
FIG. 5 is a flowchart showing a graph displaying method.

FIG. 5 is a flowchart showing the operation of the trend graph displaying apparatus of FIGS. 1 and 3. In FIG. 5, the X coordinate of a drawing start position is firstly determined. The drawing start position may be located at an arbitrary place in the display area, but should preferably be set on the X coordinate at the start end of the display area (step 51). Then, according to the display renewing period of the individual graph point (step 52), its corresponding data is fetched (step 53). The fetched data is converted into a Y-coordinate value (step 54), and is drawn at the X position presently set and at the Y position in the buffer corresponding to the Y coordinate value (step 55). Thereafter, the X position is incremented by one graph point (step 56), and checking is performed on whether or not the latest graph point has reached the end of the graph display area (step 57). If it has not reached the end of the graph display area, the routine is returned to step 52 to repeat the process of additionally displaying a new graph point. If it has reached the end of the graph display area, the winding-up process (step 58 ) is performed, whereupon the routine is returned to step 52 to restart the displaying of the graph from the winding-up position.

Figure 7:
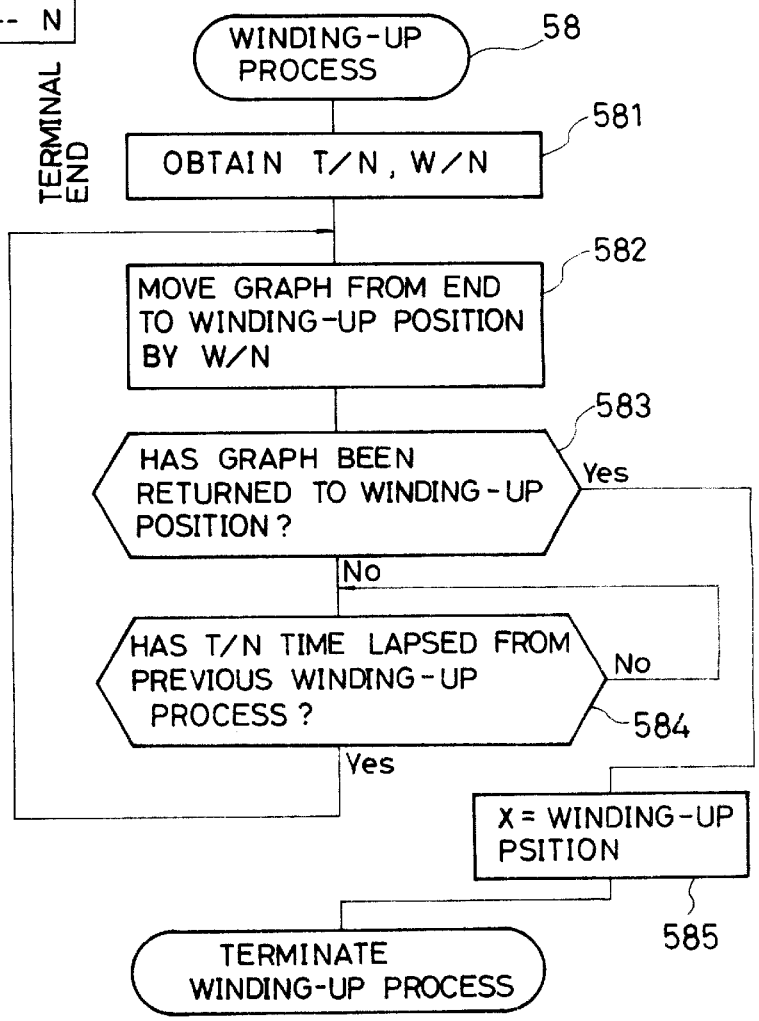

FIG. 7 is a flowchart showing the winding-up process (step 58) of FIG. 5.

Figure 6:
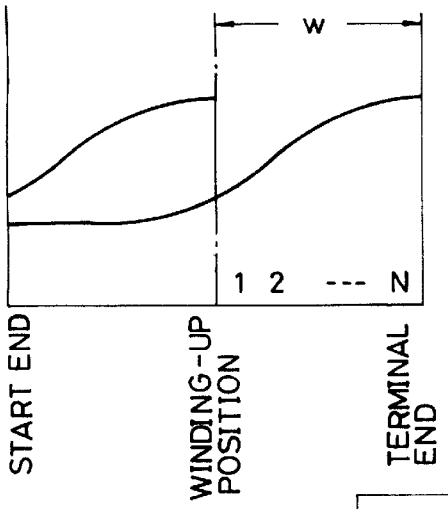
FIGS. 6 and 7 are a graph diagram and a flow-chart, respectively, showing one example of a winding-up process of FIG. 5.

For the premise to describe the winding-up process of FIG. 7, in the graph shown in FIG. 6, 'W' stands for the width of winding-up, while 'T' and 'N' stand for winding-up control variables. The variable T represents a time taken for winding up the graph, and the variable N corresponds to the number of transient graphs of the winding-up process. Therefore, for moving a graph from the end of the graph display area to the winding-up position at a uniform speed during the winding-up process, it is preferable to move the graph intermittently by a distance of W/N and at a time interval of T/N.

The winding-up position of the winding-up width W may be located at an arbitrary position between the start end and the terminal end of the graph display area. However, the winding-up position too close to the start end would cause the displayed content to be markedly changed due to the winding-up action so that it is difficult to secure continuity of the graph. Also the winding-up position too close to the terminal end would cause the winding-up action to be repeated frequently, which is laborious to observe. In general, the winding-up position should preferably be adjacent to the center of the graph display area, but it must be set a little close to the terminal end for continuously observing the entire progress of the graph.

In the winding-up process (step 58) of FIG. 7, values T/N and W/N are calculated (step 581) based on the values T, N, W stored in registers or the like (not shown) of the data processing unit 11. The values T, N, W may be designatable by the user. If the values T/N and W/N are precalculated when starting, this step 581 may be omitted.

Subsequently, the graph is moved (step 582) by W/N from the terminal end toward the winding-up position. Then, a discrimination is made (step 583) to determine whether or not the graph has been returned to the winding-up position. If it has been returned to the winding-up position, the X coordinate of the graph point is set (step 585) at the winding-up position to and the winding-up process is terminated. If the graph has not been returned to the winding-up position, after the lapse of time T/N which is equivalent to the winding-up time over one subsection (step 584), the routine is returned to step 582 to repeat the winding-up action one subsection after another.

If time T is larger than the period of time of renewing data, namely, if a new graph point is produced even during the winging-up process, such new graph point may also be wound up.

Though time T was divided uniformly (T/N is constant), it may include predetermined changes. For example, the time T may be divided in such a manner that the movement of the graph may be slowed down near its start and terminal ends, and the movement of the graph may be accelerated over its intermediate range. For this purpose, it is preferable to vary the standby time of step 584 depending on how many times the loop has been repeated. The way of varying may be predetermined.

It is possible to obtain the similar results by changing the width of each subsection of the data storage area 111 shown in FIG. 2 or the width of each subsection of the second frame buffer 116, instead of dividing time T non-uniformly. Namely, the movement of the graph is slowed down over the subsections of reduced width, and the movement of the graph is accelerated over the subsections of increased width.

Figure 8:
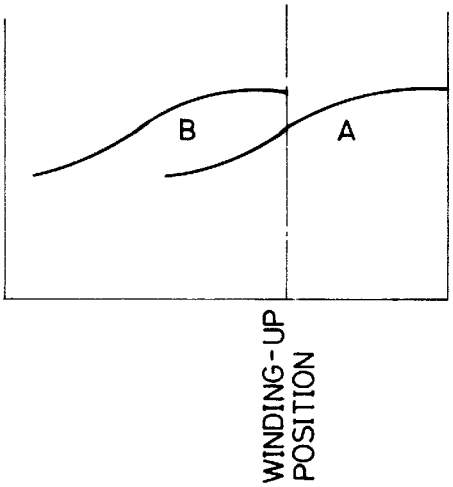
FIGS. 8 and 9 are a graph diagram and a flow-chart, respectively, showing another example of the winding-up process of FIG. 5.
Figure 9:
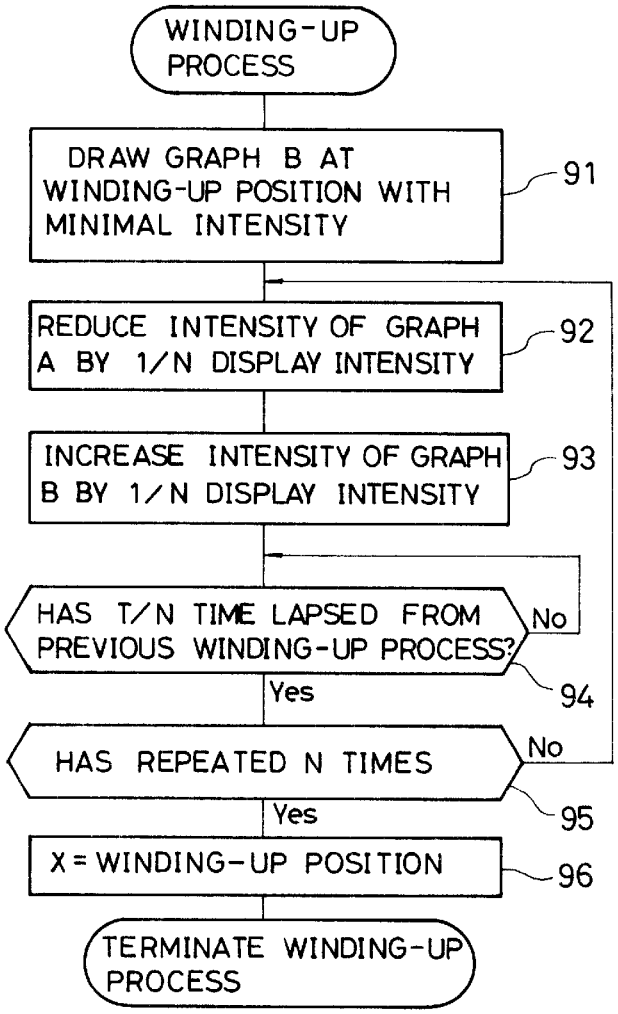

FIGS. 8 and 9 show a third embodiment of this invention; FIG. 8 is a graph diagram showing a display screen, and FIG. 9 is a flowchart showing the winding-up process.

In the third embodiment, as shown in FIG. 8, when a graph A reaches the terminal end of the graph display area, a graph B in which the end graph point of the graph A is shifted to the winding-up position is displayed with minimal intensity. Thereafter, during a constant time T, the intensity of the graph A is reduced gradually, and to the contrary, that of the graph B is increased gradually.

The third embodiment is intended to vary the intensity of a graph in N number of steps as the graph is wound up in a constant time T. Specifically, when the graph A arrives at the terminal end of the graph display area to start the winding-up process, the graph B is drawn at the winding-up position with the minimal intensity (step 91). Then, the intensity of the graph A is reduced by 1/N of the intensity while that of the graph B is increased by 1/N of the intensity (steps 92 and 93). After the lapse of T/N time from the previous changes of intensities (step 94), checking is made on whether or not reduction of intensity of the graph A and increase of that of the graph B have been repeated N times (step 95). If not, the routine is returned to step 92 to repeat changing the intensities. If they have been repeated N times, the X coordinate indicating a graph point is set at the winding-up position (step 96) and the winding-up process is terminated.

To realize the third embodiment, the apparatus of FIG. 1 or 3 may be used if the display means 12 is capable of displaying a half-tone or gray-scale graph and if the image drawing means 112 is capable of drawing the graph in the frame buffer suited for half-tone displaying.

According to this embodiment, it is possible to move the graph to the winding-up position smoothly without breaking down continuity of the operator's monitoring.

Figure 10:
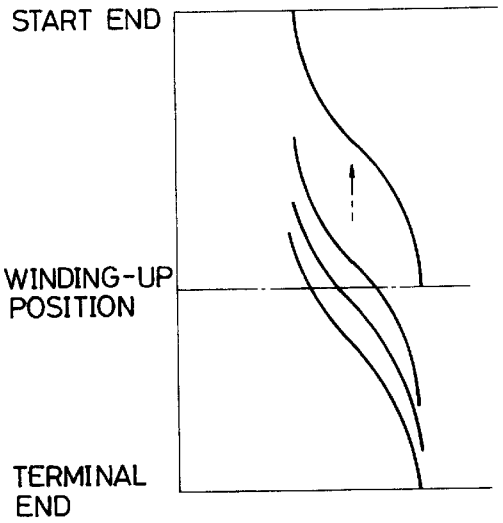
FIG. 10 is a graph diagram showing still another example of the winding-up process of FIG. 5.

FIG. 10 shows a fourth embodiment of this invention, in which the winding-up process is a composite method of the methods of FIGS. 7 and 8. Specifically, as shown in FIG. 10, when the graph reaches the end of the display area, a plurality of graphs are wound up successively toward the winding-up position in the same manner as the method of FIG. 7. In the case of the method of FIG. 7, the previous graph is erased substantially concurrently with the drawing a new graph. In the fourth embodiment, the previous graph is not instantaneously erased, but its intensity is reduced gradually in a constant time. The apparatus for realizing the fourth embodiment is identical with that of FIG. 8.

According to the fourth embodiment, it is possible to streamline the winding-up action so that the operator can monitor the graph on a continual basis without loosing sight of the graph.

Figure 11:
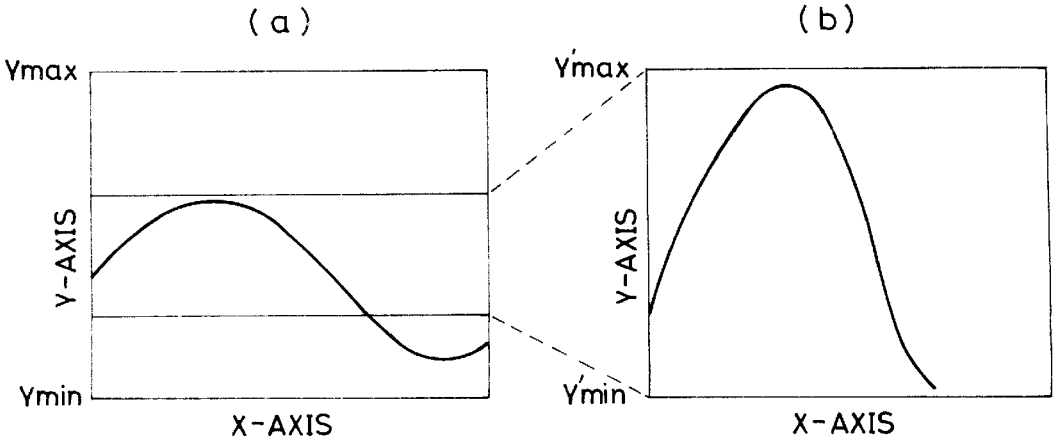
FIG. 11, (*a*) and (*b*), shows another graph displaying method.

FIG. 11, (*a*) and (*b*), shows a fifth embodiment in which this invention is used to change over the range of display; (a) shows a graph before varying the range, and (b) shows the same graph after having varied the range of display.

Assume that the maximal and minimal values of Y axis of the graph display area are (Ymax, Ymin) and become (Y'max, Y'min) after having varied the range. Also assume that the maximal and minimal values of absolute coordinate on Y axis of the display area are (AYmax, AYmin).

The absolute coordinate value AYm on Y axis of data Dm before varying the range of display is expressed by:

$$AYm = (AYmax - AYmin) \times \frac{Dm - Ymin}{Ymax - Ymin} + AYmin$$

The absolute coordinate value AY'm on Y axis of data Dm after having varied the range of display is expressed by:

$$AY'm = (AYmax - AYmin) \times \frac{Dm - Y'min}{Y'max - Y'min} + AYmin$$

A graph is moved gradually displaying a plurality of intermediate steps, as the graph is varied due to the range change, so that the varying graph can be followed by the operator's eyes. For this purpose, assume that as variables T and N for controlling the change of the graph shape, T stands for the time taken to complete the graph change, and N stands for the number of intermediate states of the change. To generate an intermediate-step graph when the range is varied from (Ymax, Ymin) to (Y'max, Y'min), obtain the maximal and minimal values (Ymax(a), Ymin(a)) of the graph display area for every intermediate step at a time interval of T/N, and then obtain graph points corresponding thereto. The maximal and minimal values (Ymax(a), Ymin (a)) on Y axis of each range of the intermediate steps are respectively expressed by:

Ymax(a)=(a/N)(Y'max−Ymax)+Ymax, and

Ymin(a)=(a/N)(Y'min−Ymin)+Ymin

Therefore, the coordinate values of the intermediate-step graph can be obtained by calculating the absolute coordinate value AY'm(a) on Y axis of the data Dm every T/N period of time where a=1, 2, . . . N. The coordinate value AY'm(a) for each intermediate step will be:

$$AY'm(a) = (AYmax - AYmin) \times \frac{Dm - Y'min(a)}{Y'max(a) - Y'min(a)} + AYmin$$

The manner of displaying of the intermediate-step graphs may be any one of the various kinds of winding-up processes discussed above. If the intensities of the two graphs before and after the winding-up process is to be varied as shown in FIG. 8, the coordinate calculating process of the intermediate-step graphs may be omitted.

In the fifth embodiment, the range is varied only on Y axis. The same concept may be adapted also on X axis.

According to this embodiment, when varying the range of graph display, it is possible to vary the graph smoothly at a speed that can be followed by the operator's eyes. Such speed may be set to an arbitrary value; visually, on an ordinary CRT screen the time taken for movement of the entire graph should preferably be larger than 0.1 sec, more preferably larger than 0.5 sec.

This embodiment is particularly suitable in monitoring a kind of process, in which the range of graph display is changed over to observe fine changes of graph with minute accuracy when the graph renewing period of time is relatively short, ranging from several msec to about several sec. This is true because the considerable change in the amplitude and time axis, namely, the shape of graph due to the change-over of the graph range as well as the chronological change of data can be followed by the operator's eyes concurrently without interruption.

With the graph displaying method of this invention, continuity of the operator's monitoring can be secured without being broken down during the winding-up process, thus preventing misrecognition of the graph. Therefore, this invention is also advantageous when embodied in a processing operation monitoring apparatus which displays the chronological change of a process parameter by a graph, thereby facilitating monitoring of the process and hence guaranteeing reliable operation. Further, the operator can freely adjust the winding-up speed and position as well as the varying of time graduations.

What is claimed is:

1. A graph displaying method for sequentially displaying data representative of quantity varying with time on a display screen, the method comprising the steps of:

inputting data representative of levels of quantity varying with time as a succession of graph points;

sequentially displaying said succession of graph points on a display screen from one end of the display screen toward the other end of the display screen as a graph;

automatically moving the graph to a predetermined position toward the one end of the display screen at a speed which can be followed by the operator's eye, by sequentially displaying transient graphs between the other end of the display screen and the predetermined position, when the succession of graph points reaches the end of a graph display area on the display screen; and displaying an additional succession of graph points, one graph point at a tim at a leading end of the graph.

2. A graph displaying method according to claim 1, in which N number of successive transient graphs are sequentially displayed during said moving of the graph from a start position to an end position, where N stands for an integer equal to or larger than one.

3. A graph displaying method according to claim 2, in which said N number of successive transient graphs are sequentially erased, each immediately after being displayed.

4. A graph displaying method according to claim 2, in which said N number of successive transient graphs are sequentially erased in such a manner that the intensities of the graphs are reduced gradually in the order the successive transient graphs have been displayed.

5. A graph displaying method according to claim 1, in which a time taken to move the graph from the end of said graph display area to said predetermined position is optionally settable.

6. A graph displaying method according to claim 2, in which a time taken to move the graph from the end of said graph display area to said predetermined position is optionally settable.

7. A graph displaying method according to claim 2, in which the value N is optionally settable.

8. A graph displaying method according to claim 2, in which a time interval of displaying the N number of successive transient graphs is variable with time.

9. A graph displaying method according to claim 2, in which distances between the N number of successive transient graphs are non-uniform.

10. A graph displaying method for sequentially displaying a data quantity varying with time, as a succession of graph points, on a display screen from one end of the display screen toward the other end, said method comprising the steps of:

displaying a first succession of graph points on the display screen from the one end of the display screen toward the other end of the display screen;

displaying, when first succession of graph points reaches an end of a graph display area of the display screen, an additional succession of graph points which has been moved to a predetermined position toward said one end of the display screen, while the first succession of graph points having reached the end of said graph display area is maintained as displayed; and gradually reducing the intensity of said first succession of graph points, while gradually increasing the intensity of said additional succession of graph points.

11. A graph displaying method comprising the steps of:

displaying data in the form of a graph within a graph display area of a display screen; and when a current range of said graph display area is switched to a new range with the graph being displayed in said graph display area, modifying the displaying of the graph for the new range such that a plurality of transient graphs are sequentially displayed between the graph of the current range and the graph of the new range, thereby representing switching of the display of the graph from the current range to the new range.

12. A graph displaying method comprising the steps of:

displaying data in the form of a graph within a graph display area of a display screen; and when a current range of said graph display area is switched to a new range with the graph being displayed in said graph display area, modifying the displaying of the graph for the new range such that the intensity of the graph of the current range is gradually reduced, while the intensity of the graph of the new range is gradually increased, thereby representing switching of the display of the graph from the current range to the new range.

13. A graph displaying apparatus comprising:

(a) a data processing unit for sequentially processing data, which is inputted and varies with time, into a succession of graph points;

(b) a display unit for sequentially displaying the succession of graph points from said data processing unit on a display screen from one side thereof to the other as a graph;

(c) said display unit includes a graph wind-up means for moving the graph from said other side of the display screen to a predetermined position toward said one side of the display screen at a speed which can be followed by the operator's eyes, by sequentially displaying transient graphs between the other side of the display screen and the predetermined position, when the succession of graph points reaches an end of a graph display area on said other side of the display screen.

14. A graph displaying apparatus according to claim 13, in which said data processing unit is capable of further displaying an additional succession of graph points sequentially, one at a time at a leading end of the graph.

15. A graph displaying apparatus according to claim 13, in which the predetermined position is located substantially in the midst of the graph display area.

16. A graph displaying apparatus comprising:

(a) a data processing unit for sequentially processing data, which is inputted and varies with time, into a succession of graph points; and (b) a display unit for sequentially displaying the succession of graph points from said data processing unit on a display screen from one side of the display screen to the other as a graph;

(c) said display unit includes a graph wind-up means for moving the graph from said other side of the display screen to a predetermined position toward said one side of the display screen when the succession of graph points reaches an end of a graph display area on said other side of the display screen, by automatically and sequentially displaying N number of successive transient graphs between said other said of the display screen and said predetermined position during said moving of the graph, where N stands for an integer equal to or larger than one.

17. A graph displaying apparatus comprising:

(a) a data processing unit for sequentially processing data, which is inputted and varies with time, into a succession of graph points and for controlling displaying of the graph; and (b) a display unit for displaying a first succession of graph points applied from said processing unit on a display screen from one side thereof to the other;

(c) said data processing unit being equipped with an image display means for moving, when the first succession of graph points reaches the end of the graph display area on the display screen, a display of the graph corresponding to the first succession of graph points to a predetermined position toward said one side of the display screen while the display of the first succession of graph points having reached the end of said graph display area is maintained;

(d) said data processing unit being capable of gradually reducing the intensity of said first succession of graph points, while gradually increasing the intensity of an additional succession of graph points added to the display of the graph which has been moved.

18. A processing operation monitoring apparatus comprising:

(a) a data processing unit for sequentially processing data, which is inputted and varies with time, into a succession of graph points and for controlling displaying of a graph corresponding to the succession of graph points; and (b) a display unit for displaying the succession of graph points applied from said processing unit on a display screen from one side thereof to the other;

(c) said data processing unit being equipped with an image drawing means for sequentially displaying, when changing a time-axis coordinate of the graph a plurality of graphs representing transient states of the graph during the changing to represent changing of a time-axis coordinate of a display of the graph from a current time-axis coordinate to a new time-axis coordinate.

19. A processing operation monitoring apparatus according to claim 18, in which the changing of said time-axis coordinate is performed by winding up the graph at the end of said display area where the data varying with time is displayed as an additional succession of graph points.

20. A processing operation monitoring apparatus according to claim 18, in which the changing of said time-axis coordinate is performed by switching a range to expand or reduce the size of the graph to be displayed.

* * * * *